US011898806B2

(12) United States Patent
Horoszczak et al.

(10) Patent No.: US 11,898,806 B2
(45) Date of Patent: Feb. 13, 2024

(54) HEAT EXCHANGER

(71) Applicant: Hamilton Sundstrand Corporation, Charlotte, NC (US)

(72) Inventors: Adam Horoszczak, Wroclaw (PL); Rafal Lewandowski, Zarow (PL)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 387 days.

(21) Appl. No.: 17/009,118

(22) Filed: Sep. 1, 2020

(65) Prior Publication Data

US 2021/0116186 A1 Apr. 22, 2021

(30) Foreign Application Priority Data

Oct. 18, 2019 (EP) ..... 19204166

(51) Int. Cl.
*F28F 1/02* (2006.01)

(52) U.S. Cl.
CPC ..... *F28F 1/022* (2013.01); *F28F 1/025* (2013.01)

(58) Field of Classification Search
CPC .. F28F 1/025; F28F 9/26; F28F 9/0202; F28F 9/0268; F28D 7/0025; F28D 7/06; F28D 9/0056; F28D 1/0383; F28D 1/0341; F28D 1/0475; F28D 1/0476; F28D 9/0037; F24F 3/147
See application file for complete search history.

(56) References Cited

U.S. PATENT DOCUMENTS 1,409,520 A * 3/1922 Bird ..... F24F 3/147 119/315
2,812,165 A * 11/1957 Hammond ..... F28D 9/00 165/DIG. 387

(Continued)

FOREIGN PATENT DOCUMENTS

DE 243091 A1 2/1987
EP 0661508 A1 7/1995

(Continued)

OTHER PUBLICATIONS

European Search Report for Application No. 19204166.3, dated Apr. 22, 2020, 5 pages.

*Primary Examiner* — Jianying C Atkisson
*Assistant Examiner* — For K Ling
(74) *Attorney, Agent, or Firm* — CANTOR COLBURN LLP

(57) ABSTRACT

A layer of a heat exchanger includes plurality of flow paths, a first end section comprising a plurality of flow path inlets and a plurality flow path outlets. a second end section comprising a turnaround section, a first morphing section fluidly connect to the first end section, a second morphing section fluidly connected to the second end section; and a central section positioned between and fluidly connected to the first and second morphing sections. The plurality of flow paths extend from the flow path inlets to the flow path outlets via the turnaround section in the second end section. In the first end section and the second end section the flow paths have a first cross section. The central section the flow paths have a second cross section and in the first and second morphing section the cross section of the flow paths morph between first and second cross sections.

13 Claims, 8 Drawing Sheets

(56) References Cited

U.S. PATENT DOCUMENTS 4,823,867 A * 4/1989 Pollard ..... F28F 9/001 165/DIG. 356
5,029,639 A * 7/1991 Finnemore ..... F28D 9/0025 165/DIG. 356
5,078,208 A * 1/1992 Urch ..... F28D 9/0037 165/DIG. 399
5,531,268 A * 7/1996 Hoshino ..... F28F 1/025 165/149
5,725,051 A * 3/1998 Veltkamp ..... F28F 21/06 165/165
6,076,598 A * 6/2000 Doi ..... F28D 9/0037 165/905
6,161,616 A * 12/2000 Haussmann ..... F28D 1/05391 165/174
6,168,765 B1 * 1/2001 Romatier ..... F28F 3/04 165/DIG. 356
7,285,153 B2 * 10/2007 Bruun ..... F28F 7/02 165/DIG. 395
9,593,647 B2 * 3/2017 Demots ..... F28F 1/12
10,094,628 B1 10/2018 Mironets et al.
2004/0050531 A1 3/2004 Horiuchi et al.
2005/0217837 A1 * 10/2005 Kudija ..... F28D 7/0008 165/165
2008/0085437 A1 * 4/2008 Dean ..... H01M 8/04014 429/514
2013/0264031 A1 * 10/2013 Plourde ..... F28F 1/022 165/104.11
2014/0326432 A1 * 11/2014 Dean ..... F28F 9/26 165/104.14
2015/0252727 A1 * 9/2015 Aoki ..... B64D 37/34 165/51
2017/0146305 A1 * 5/2017 Kuczek ..... F28F 9/0268
2017/0198978 A1 7/2017 Kuczek et al.
2017/0198979 A1 7/2017 St. Rock et al.
2017/0205146 A1 7/2017 Turney et al.
2017/0211826 A1 * 7/2017 Mariotto ..... F24F 3/147
2017/0363361 A1 12/2017 Turney
2018/0043482 A1 2/2018 Vos et al.
2018/0172356 A1 6/2018 Whalley et al.
2018/0266770 A1 * 9/2018 Wagner ..... F28D 7/0025
2019/0033016 A1 * 1/2019 Aoki ..... F28D 9/0037
2019/0285349 A1 9/2019 Streeter et al.
2021/0102756 A1 * 4/2021 Becene ..... F28F 7/02

FOREIGN PATENT DOCUMENTS

EP 2175222 A1 4/2010
GB 2116687 A * 9/1983 ..... F28D 1/0383

* cited by examiner

HEAT EXCHANGER

FOREIGN PRIORITY

This application claims priority to European Patent Application No. 19204166.3 filed Oct. 18, 2019, the entire contents of which is incorporated herein by reference.

TECHNICAL FIELD

The invention relates to a heat exchanger and to a method of manufacturing a heat exchanger.

BACKGROUND

Heat exchangers for transfer of heat between different fluids are very widely used and exist in various forms. Typically heat exchangers are arranged for flow of a primary fluid and a secondary fluid with heat being transferred between the two fluids as they flow through the device. Multi-stream heat exchangers for exchanging heat between more than two fluids also exist in the prior art. Heat exchangers are required within aircraft structures to regulate temperatures of working fluids as well as to scavenge heat from one system for use in another. Every heat exchanger consumes significant space within an aircraft structure, including in certain areas of the aircraft structure space is at a premium. It is therefore desirable to provide an optimised heat exchanger such that the maximum amount of heat transfer can take place. It is also beneficial for the heat exchangers to be optimised in size whilst still providing efficient heat transfer so that they can fit within space required.

Some heat exchangers have a layered structure with a large number of parallel flow paths between plates that separate the flow paths. There may be 50-200 plates, or more, in this type of heat exchanger, typically with alternating hot/cold fluid flow paths either side of each plate. Such heat exchangers can also be referred to as laminate heat exchangers.

Heat exchangers may employ either counter flow or parallel flow. In parallel flow arrangements the hot and cold flows travel in the same direction, whereas in counter flow arrangements they travel in opposite directions. Heat exchangers can also employ cross flow where the hot and cold fluid travel in perpendicular directions.

In typical laminate heat exchangers the plates are flat plates. The flow paths in each layer of the heat exchanger may therefore be square or rectangular in cross section.

In certain cases the flow paths channels of each layer within the heat exchanger may have diamond shape cross sections. Diamond channel heat exchangers provide improved performance compared to convention plate fin heat exchanger because with the use of diamond channels all of the internal core faces act as primary heat transfer surfaces.

At present, due to structural and interface restrictions, and performance requirements, it is not possible to effectively use cross flow in diamond channel heat exchangers. Furthermore, existing proposals for diamond channel heat exchangers often only allow for single pass flow where each side of the heat exchanger includes and inlet for the hot fluid and outlet for the cold fluid or vice versa.

It is advantageous to use multiple pass flow as there will be more contact time between the hot and cold flow meaning greater heat transfer. Therefore, more heat transfer is able to take place without significantly increasing the volume of the heat exchanger. Another benefit of two-pass heat exchangers is that the inlet and outlet for the hot fluid can be one side and the inlet and outlet for the cold fluid can be on the other side, or all of the inlet and outlet connections can be on a single side. Having both the inlet and outlet on the same side for each fluid may make it easier to arrange the heat exchanger amongst the other components of a broader system.

There is therefore a desire to provide a heat exchanger with diamond channel flow paths capable of being used for parallel or counter flow and also, if needed, cross flow to further improve the efficiency of the heat exchanger.

SUMMARY

Viewed from a first aspect, there is provided a layer for a multilayer heat exchanger, the layer comprising: a plurality of flow paths; a first end section comprising a plurality of flow path inlets and a plurality flow path outlets; a second end section comprising a turnaround section; a first morphing section fluidly connect to the first end section; a second morphing section fluidly connected to the second end section; and a central section positioned between and fluidly connected to the first and second morphing sections; wherein the plurality of flow paths extend from the flow path inlets in the first end section to the flow path outlets at the first end section via the turnaround section at the second end section; wherein in the first end section and the second end section the flow paths have a first cross section; wherein in the central section the flow paths have a second cross section; and wherein in the first and second morphing sections the cross section of the flow paths morphs between first cross section and the second cross section.

The heat exchanger of the first aspect allows for the most suitable cross section to be used at each section of the heat exchanger layer. For example, most heat transfer will occur in the central section and so the present invention can be formed with the cross section most efficient for heat transfer. The heat exchange layer may be connected to the mounting points at the first and second ends, and therefore the present invention allows for the first cross section to be the shape most suitable to be accommodated by said mounting points.

The first cross section may allow for the first and second end sections to fit within an area of a first, relatively small, depth, compared to the second cross section, which may result in the central section extending across a second, larger depth. The second cross section may be arranged such that the flow paths thereof will be interleaved with flow paths of an adjacent layer, for example with the outer bounds of flow paths from adjacent layers extending beyond one another at the central section and hence overlapping with one another. In some cases the second cross section may be arranged to provide the central section with a zig-zag profile, which may have a complementary shape with a zig-zag profile of an adjacent layer in order to provide the interleaved flow paths. The first cross section may be arranged for a lesser overlap between flow paths of adjacent layers than the second cross section, or arranged for no such overlap in the first and second end sections. In some examples the first cross section provides the first and second end sections with flat outer boundaries, such that in the first and second end sections the layer has a constant depth across a width and length of the first and second end sections. Multiple layers may hence be formed with adjacent layers meeting with a flat interface in the first and second end sections, and an interleaved, non-flat interface in the central section.

The first cross section may be a rectangular cross section and the second cross section may be a diamond cross section. By having the first and second end sections with a rectangular cross section, multiple layers can be formed with a turnaround portion in which flow can be easily turned, for example via a U-shaped flow path, and it further allows for multiple layers to be formed together. It also means that existing mounting components that previously accommodated rectangular inlets and outlets on conventional plate fin heat exchangers can be used.

The use of a central section with flow paths interleaved with those of an adjacent layer, such as by using a diamond cross section, provides the advantages of a diamond channel heat exchanger, for example, in a diamond channel heat exchanger all the surfaces are primary heat transfer surfaces, in contrast to rectangular channel heat exchangers. Therefore, for a given length diamond channel there is a greater surface area for heat transfer compared to the same length of a rectangular channel.

As previously stated, prior use of diamond channels was in single pass heat exchangers without a separate turnaround section to re-distribute the flow accordingly. The morphing section allows for the central heat exchange section to use diamond channels and the first and second end sections to use rectangular channels, which then permits multiple layers with respective end sections layered together, such as with a turnaround section of one layer adjacent an inlet section of an adjacent layer.

The morphing sections further allow the first end section, the diamond channel section and the turnaround section to be integrated within the layer as one continuous flow path, without the need for a separate turnaround section to redistribute the flow. The morphing sections may comprise a shift from the first cross section to the second cross section that occurs gradually along the extent of the flow path between the central section and the first or second end section, as the case may be.

The turnaround section of each layer may be directly and/or fluidly connected to all the flow paths within that layer. The turnaround section of each layer may be a single open tank.

The proposed arrangement allows for two-pass flow which means the inlet and outlet for the fluid that passes via the flow paths can be on the same side of the layer.

A heat exchanger may be formed by forming a plurality of the above layers together. Viewed from a second aspect, the invention provides such a heat exchanger. The layer of the heat exchanger may be combined with additional layers to build-up a heat exchanger comprising multiple layers. The heat exchanger may comprise up to 50 layers, alternatively it may comprise more than 50 layers. Each layer may contain one of either a primary fluid or a secondary fluid. To allow for heat transfer the primary fluid and the secondary fluid may alternate between each layer.

The primary fluid may be hot fluid and the secondary fluid may be cold fluid, or vice versa.

Each alternating layer may be rotated 180 degrees with respect to the adjacent layers such that the first end section of one layer may be overlaid by the turnaround sections of the adjacent layers. This allows cross flow to take place as the flow of fluid in the first end section will be perpendicular to the flow of fluid in the turnaround section of the adjacent layer.

By providing a layered heat exchanger where each alternate layer may be rotated 180 degrees, and each alternating layer comprising either the primary fluid or the secondary fluid, the inlet and outlet for the primary fluid will be on one side of the heat exchanger and the inlet and outlet for the secondary fluid will be on the opposite side of the heat exchanger.

The design of the layer allows multiple layers to be stacked together, providing the previously mentioned advantages, without the requirement for any additional features to turn the flow, for example a separately mounted turnaround tank. Instead, identical layers can be staked together which each alternating layer rotated by 180 degrees. This allows for the heat exchanger to be infinitely scalable without and significant adjustment to the surrounding components.

Although diamond channels can be optimal for some situations, an in particular can maximise the ratio of primary heat transfer area to the flow volume, the first and second cross sections can be other shapes that can be effectively layered together. Any suitable stackable shape could be used. For example, the second cross section may be hexagonal. The flow paths of one layer may extend into a plane formed by the adjacent layers. A hexagonal second cross section can allow for a deeper layer. Such layers may be paired with adjacent diamond channel layers, with a different flow rate or a different fluid type in the hexagonal layer as compared to the diamond channel layer.

Each of the plurality of flow paths may have a constant cross sectional area along their length. This requires the morphing section to alter the flow path cross section in a way that the same area is maintained. By maintaining a constant cross sectional area there is no effect on the pressure of the fluid that may be caused if the morphing section was not present.

The cross section of the morphing section may be an irregular hexagonal shape. The shape of the hexagonal cross section of the morphing section may change along the length of the flow path between the first cross section and the second cross section.

The cross section of each of the plurality of flow paths may change along its length from a rectangular cross section in the first end section, to a series of irregular hexagonal cross sections in the morphing section, to a diamond cross section in the central section.

The wall thickness of each flow path may be the same in each layer. Alternatively the wall thickness may be different in each layer. The smaller the wall thickness the greater the heat transfers between adjacent flow paths. Hence, the wall thickness can be used to control the efficiency of the heat exchanger. Increasing the wall thickness may improve the structure of the heat exchanger but it will increase the weight and reduce the heat transfer able to take place between the layers.

The cross sectional area and/or the cross section of the flow paths may be the same in each layer, alternatively the cross section area and/or the cross section of the flow paths may be different in one or more layers of the heat exchanger. The cross section refers to the shape of the cross section, i.e. diamond or rectangular. Additionally the cross-sectional area of the flow paths within a single layer may be different. The cross sectional area of the flow paths can be altered by changing the wall thickness. This ensures that the size of each channel is the same, despite the flow path cross sectional area being different, hence allowing each layer to align with the adjacent layers sufficiently.

The flow paths may be different heights in each layer. In certain cases the height of the flow paths for the primary fluid may be larger than for the secondary fluid or vice versa. This provides another means for controlling the heat transfer between the fluids.

The central section of the layer of the heat exchanger may comprise multiple flow paths arranged side by side in a lateral direction of the layer. The layer of the heat exchanger may be separated into a first side and a second side by a separating wall extending in a longitudinal direction of the layer. The separating wall may be positioned so that the first side and the second side comprise the same number of flow paths. Alternatively, the separating wall may be positioned so that the first side has a greater number of flow paths than the second side, or vice versa. The positioning of the separating wall will depend on the flow characteristics of the fluid and the heat transfer required.

The plurality of flow paths may comprise a plurality of outward flow paths and a plurality of return flow paths. The outward flow paths may be on the first side of the heat exchanger, and the return flow paths may be on the second side or vice versa.

The fluid within the flow paths in the first side and second side may travel in opposite directions. Fluid in the first side may enter the central section from the inlets of the first end section through the first morphing section and then leave via the second morphing section into the turnaround section. Fluid on the second side may enter the central section from the turnaround section through the second morphing section then leave via the first morphing section through the outlets in the first end section.

The separating wall may extend the entire length of the central section. Alternatively, the separating wall may extend from the first end section of the heat exchanger to the second morphing section. As a further alternative the separating wall may extend from the first end section to the turnaround section.

The layer of the heat exchanger may further comprise an enclosed flow path channel in the central section directly adjacent to the separating wall wherein the enclosed flow path channel does not extend into the turnaround section. Additional enclosed flow path channels either side of the separating wall may also be present and not extend into the turnaround section. The fluid present in the enclosed flow path channel may be contained within it and not enter the turnaround section.

This ensures that the return section of each flow path is fully utilised. Due to the nature of the flow moving through the turnaround section, if the channels adjacent to the separating wall were opened into the turnaround section, fluid may inadvertently bypass the return section of these flow paths on the second side. Therefore by stopping the flow paths prior to the turnaround section this ensures a maximum surface area for heat transfer is maintained and provides a more even fluid distribution.

The outward flow paths may be the same length, and the return flow paths may be the same length. As the enclosed flow paths do not extend to the turnaround section, the length of the outward and return sections of the enclosed flow paths may be less than the outward flow paths and return flow paths.

Alternatively, the length of each outward and return flow path of the flow paths may differ. The length can be adjusted by altering the length of the various sections of the flow paths.

The first morphing section of each of the flow paths may be the same length, alternatively the flow paths adjacent to the separating wall may have a longer morphing section. The length of the first morphing section may depend on the length of the flow path within the central section.

The first cross section may extend by the same amount along all the flow paths. Alternatively, in some embodiments the first cross section may extend further along the length some flow paths than other. For example, the first cross section may extend further along the length of the flow paths adjacent to the separating wall, i.e. at a middle part of the layer.

Additionally, the first cross section may extend a different length along each flow path. For example, in flow path directly adjacent to the separating wall the length of the flow path with the first cross section may be the largest, therefore that flow path will have the shortest section with the second cross section. In the flow path adjacent to the flow path directly adjacent to the separating wall the section with the first cross section may be slightly shorter than for the flow path directly adjacent to the separating wall. This flow path will therefore have a slightly longer section with the second cross section than the flow path directly adjacent to the separating wall.

The sections of the flow paths with the first cross section may gradually decrease with distance from the separating wall until a limit for the length of the first cross section The central section of the layer may be the largest section of the layer. For example, the central section may be 60-80% of the entire length of the layer, wherein the length is from the outer point of the first section to the outer point of the second section comprising the turnaround section.

The first and second morphing sections may be equal in length. Alternatively, the first morphing section may be longer than the second morphing section and vice versa. The first and second morphing sections may be the shortest sections of the layer, for example the first and second morphing sections may each be 3% to 10% of the entire length of the layer.

The first end and the turnaround section may be equal in length. Alternatively, the first end may be longer than the turnaround section and vice versa. The first end and turnaround section may each be 8% to 15% of the entire length of the layer.

Vanes may extend from the plurality of outward flow paths into the turnaround section. These vanes encourage the flow to change direction and therefore improve the flow characteristics and reduce pressure drop in the turnaround section.

The heat exchanger device may be for use with any required combination of fluids, such as liquid-liquid, liquid-gas or gas-gas heat exchange. The heat exchanger may use air for heating or cooling of another fluid. In some examples the heat exchanger is for aerospace use and the invention thus extends to an aircraft including the heat exchanger device. In context of aerospace use the fluids could include two or more of: atmospheric air, cabin air, engine oil, generator oil, coolant, fuel and so on. Any combination of these fluids can be used within the same heat exchange deice, it is not limited to two types of fluid. The fluid used depends on the requirements of the heat exchanger as different fluid will have different thermal and fluidic properties. Some fluid will move with a lower/higher velocity than others which may be preferable in certain situations to provide the necessary thermal transfer.

Viewed from another aspect, there is provided a method for manufacturing a layer for a multilayer heat exchanger, wherein the layer comprises: a plurality of flow paths; a first end comprising a plurality of flow path inlets and a plurality of flow path outlets; and a second end comprising a turnaround section; wherein the plurality of flow paths extend from the flow path inlets at the first end to the flow path outlets at the first end via the turnaround section at the second end; the method comprising forming a first morphing section adjacent to the first end; forming a second morphing section adjacent to the second end; and forming a central section located between the first and second morphing sections; wherein in the first end the flow paths are formed with a first cross section, wherein in the central section the flow paths are formed with a second cross section; and wherein in the first and second morphing section the cross section of the flow paths are formed so that they morph between the first cross section and the second cross section.

The method may include providing the layer of the heat exchanger with any of the features discussed above in connection with the first aspect. The invention may extend to a method for manufacturing a heat exchanger comprising forming multiple adjacent layers, each layer being as discussed above.

The layer of the heat exchanger may be formed by additive manufacturing. Alternatively the layer of the heat exchanger may be formed from conventional manufacturing techniques such as stamping.

Due to the complex internal nature of the layer additive manufacturing is the most suitable method for manufacture. Further, this technique allows the structure to be modified, such as altering the height of the channels, thickness of the walls and the number of flow paths. The structure can be further modified by changing the size of each section, for example the morphing section can be the same length across the entire width of the layer, or it can be longer at certain points. Additive manufacturing also allows for more rapid production.

Additive manufacturing provides a further advantage in that a multi-layered heat exchanger can be formed as one piece, alternatively, each layer can be formed individually and the layers can then be stacked together appropriately.

The open turnaround section of the heat exchanger means that powder formed during the printing process is easily removed.

Due the improved efficiency of the heat exchanger compared to convention pin fin heat exchangers, smaller heat exchangers can be designed. This will reduce the cost of manufacture, in particular less metallic powder is required and the printer bed can also be reduced in size.

The choice of manufacturing process may be determined by the required strength and thermal properties of the heat exchanger, as each manufacturing method is better suited to certain materials that may have more preferable properties for the requirements.

BRIEF DESCRIPTION OF THE DRAWINGS

Example embodiments of the invention are described below by way of example only and with reference to the accompanying drawings.

DETAILED DESCRIPTION

Figure 1:
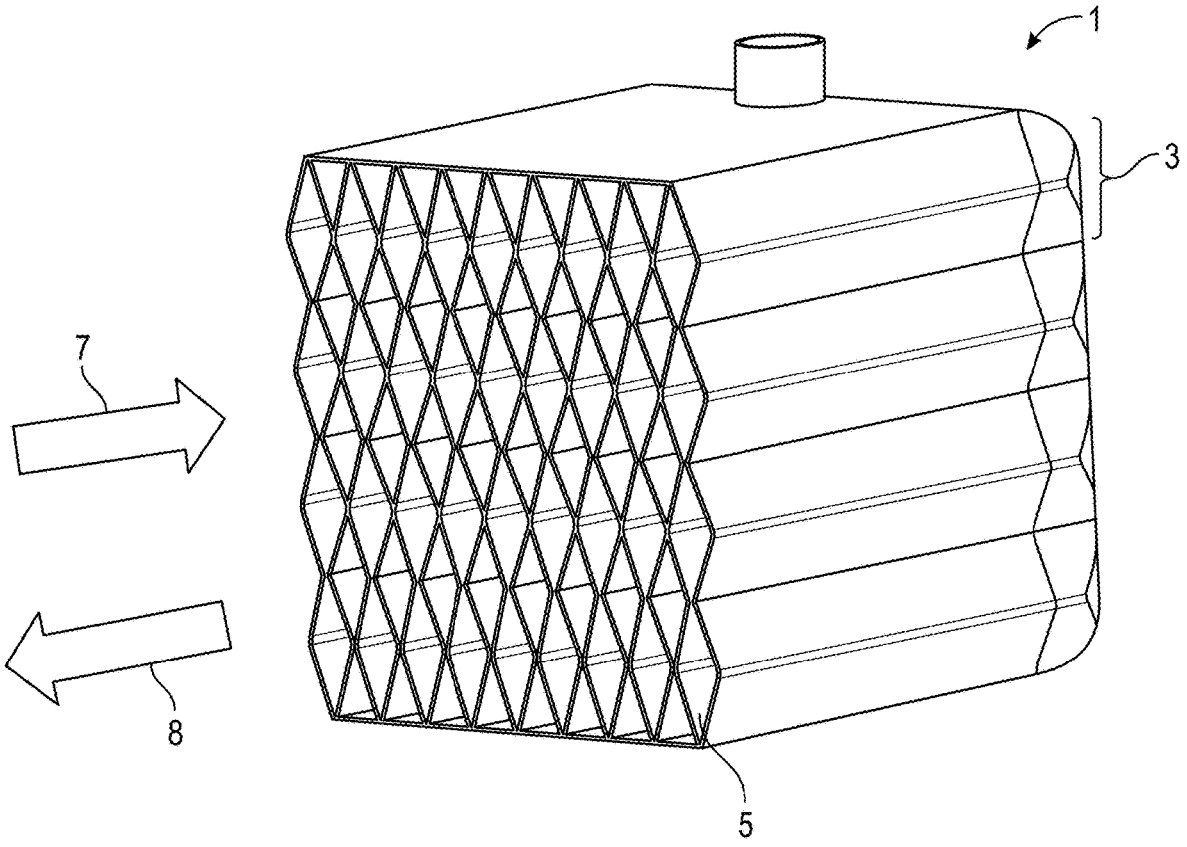
FIG. 1 shows a core for a diamond channel heat exchanger.

FIG. 1 shows a core for a diamond channel heat exchanger 1 comprising a plurality of layers 5. The heat exchanger 1 is a single pass counter flow heat exchanger. Each layer 5 comprises a plurality of flow paths 5 wherein the primary fluid 7 and the secondary fluid 8 flow in alternating layers and in opposite directions.

Each side of the heat exchanger 1 comprises the inlet for one of the primary fluid 7 or secondary fluid 8 and the outlet for the other.

Figure 2A:
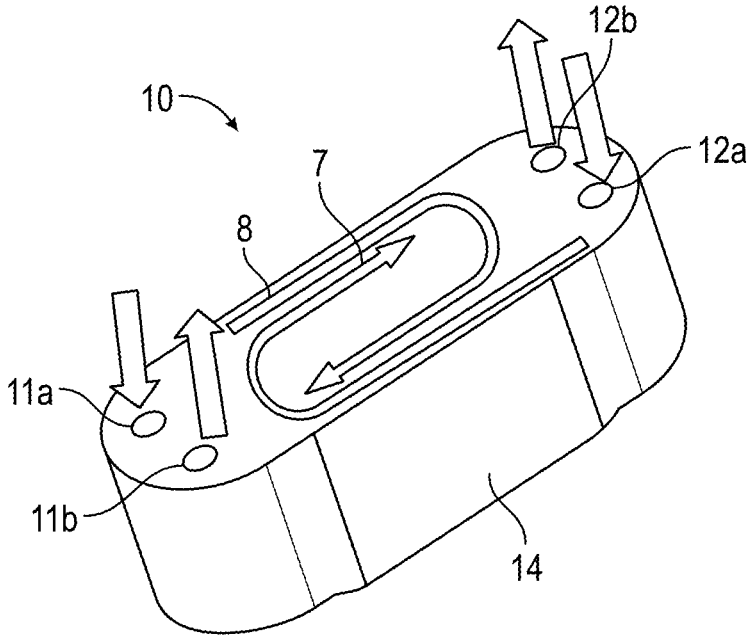
FIG. 2A shows a schematic of a two-pass heat exchanger.
Figure 2B:
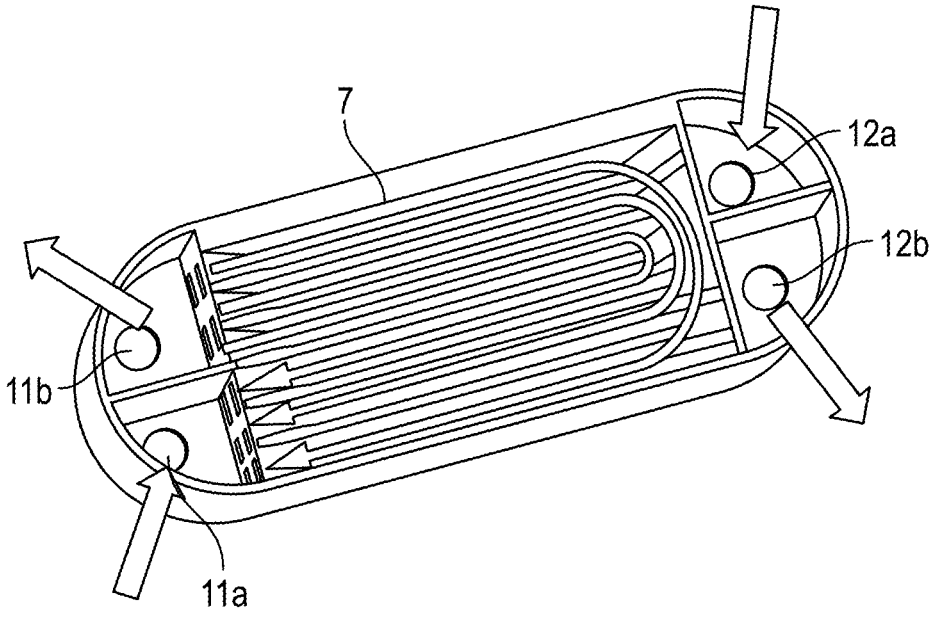
FIG. 2B shows a cut-away view of the two-pass heat exchanger as shown in FIG. 2A.

FIGS. 2A and 2B show a two pass heat exchanger. The main section 14 of the heat exchanger comprises multiple layers, where each layer contains either the primary fluid 7 or the secondary fluid 8.

As the heat exchanger 10 incorporates two-pass flow, the primary fluid inlet 11*a* and the primary fluid outlet 11*b* are on one side of the heat exchanger 10 and the secondary flow inlet 12*a* and the secondary flow outlet 12*b* are on the other side of the heat exchanger 10.

FIG. 2B shows a cut-away view showing a single layer of the heat exchanger 10 with an integrated turnaround section so that the primary fluid inlet 11*a* and outlet 11*b* are located on the same side of the heat exchanger.

Figure 3:
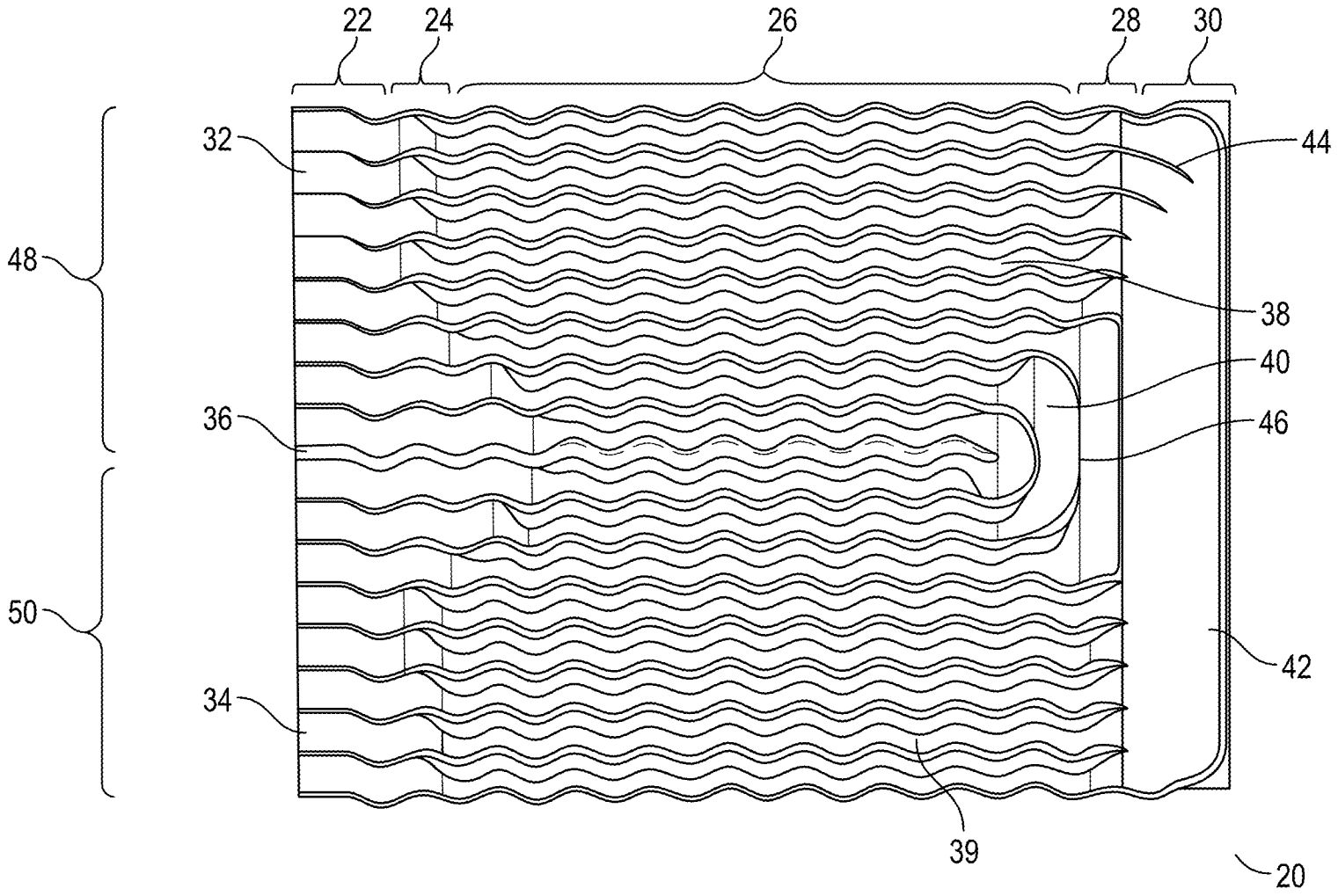
FIG. 3 shows a cut-away view of a layer of a heat exchanger including morphing sections.

FIG. 3 shows a layer 20 of a heat exchanger incorporating both diamond channels and rectangular channels within its flow paths. The layer 20 comprises a first end 22 with a first morphing section 24 directly and fluidly connected to the first end 22. A central section 26 is adjacent to and directly connected to the first morphing section 24 and a second morphing section 28. The second morphing section 28 is directly and fluidly connected to a second end 30 which comprises a turnaround section 42.

The layer 20 of the heat exchanger is separated into a first side 48 and a second side 50 by a separating wall 36. The layer 20 of the heat exchanger comprises a plurality of flow paths 38, 39 where the flow paths on the first side 48 are the outward flow paths 38 and the flow paths on the second side 50 are the return flow paths 39. The separating wall 36 thus separates the outward flow paths 38 and the return flow paths 39.

In the example of FIG. 3 the inlets 32 and outward flow paths 38 are on the first side 48 and the outlets 34 and return flow paths 39 are on the second side 50, however it will be appreciated that the inlets 32 and outward flow paths 38 can be on the second side 50 and the outlets 34 and the return flow paths 39 can be on the first side 48.

The outward flow paths 38 extend from the inlets 32 through the first morphing section 24, the central section 26 and the second morphing section 28 into the second end 30. At the second end 30 the plurality of flow paths 38 are directly and fluidly connected to and open out into the turnaround section 42.

The turnaround section 42 is also directly and fluidly connected to the plurality of return flow paths 39, which then extend through the second morphing section 28, the central section 26, first morphing section 24 and the plurality of outlets 34.

In addition to the plurality of flow paths 38, 39 that open into the tank within the turnaround section 42 there are also one or more enclosed flow paths 40 closest to the separating wall 36. FIG. 3 shows three enclosed flow paths 40, however there may be only one enclosed flow path 40 or alternatively there could be more than three.

The enclosed flow paths 40 do not extend into the turnaround section 42 in the second end 30. Instead the enclosed flow paths 40 turn individually and the flow path side wall 46 constrains the fluid within the flow path at the turning point.

The enclosed flow paths 40 ensure that sufficient fluid is present in all the flow paths 38, 39, 40 within the layer.

Some of the flow paths 38, 39 further comprise vanes 44, which extend from the end of the flow path section within the second morphing section into the turnaround section 42. In FIG. 3 the vanes extend from the outward flow path 38 and encourage the flow to change direction towards the inlets of the return flow paths 39.

Figure 4:
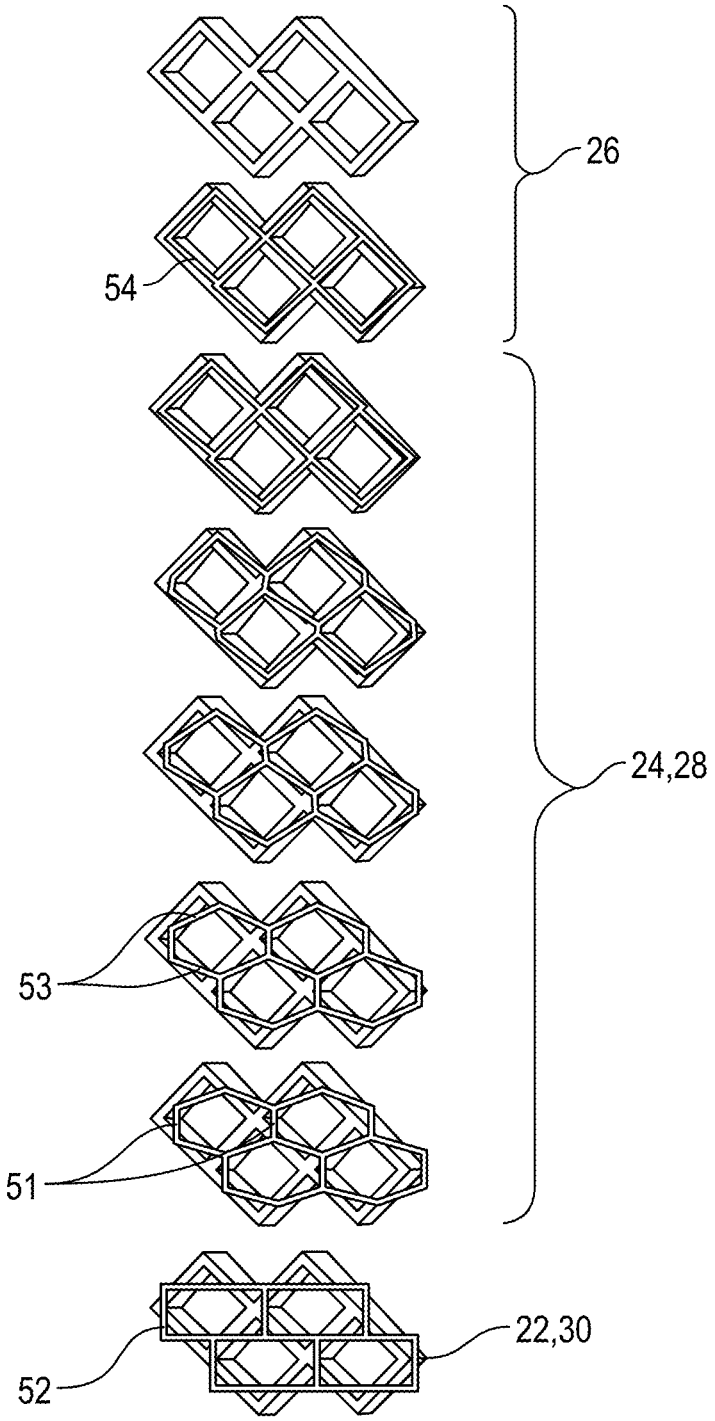
FIG. 4 shows a series of cross sections of for two layers of a heat exchanger illustrating the changes along the extent of a morphing section.

FIG. 4 shows the change in cross section of the flow paths 38, 39 between the first and second end 22, 30 and the central section 26 through the morphing sections. As seen in the progression between the diamond channel shape in the top image and the rectangular channel shape at the bottom, the cross sections of the flow paths 38, 39 change gradually between a first cross section 52 at the first end 22 to a second cross section 54.

In the example of FIG. 4 the first cross section 52 at the first end 22 and the second end 30 are rectangular. In the first and second morphing sections 24, 28 the cross section gradually changes in a linear manner in incremental steps while maintaining a constant cross-sectional area.

In the morphing section of FIG. 4, the cross section forms a series of irregular hexagons transitioning from rectangular to diamond. The cross section of the flow path comprises a first pair of sides 51 and a second pair of sides 52. In the morphing section of the flow path, each of the second pair of sides 52 split into two sections of equal length with an apex/bottom in the middle forming an obtuse angle so that the cross section of the flow path is an irregular hexagon.

Along the length of the morphing section the length of each of the first pair of sides gradually decreases, while each side remains equal. As the length of the first pair of sides decreases the angle of the apex/bottom in each of the second pair of sides 52 decreases and the length of each section of the second pair of sides 52 increases.

Along the length of the morphing section the length of each of the first pair of sides gradually decreases to zero and the angle of the apex/bottom gradually decreases to be a right-angle so that the cross section morphs from hexagonal to a diamond cross section.

In the central section 26, where the majority of the heat transfer is taking place, the second cross section 54 is a diamond cross section. It will be appreciated that second cross section 54 can have other shapes, for example hexagonal. An advantage of a diamond cross section for the main core of the heat exchanger is that every surface of the flow path channel acts as a primary heat transfer surface.

As can be seen in FIG. 3 the flow paths 38, 39 in the central section 26 are of equal length, however the enclosed flow paths 40 decrease in length so that the enclosed flow paths 40 closest to the separating wall 36 are shorter than the enclosed flow paths 40 further from the wall. It will be appreciated that the flow paths 38, 39 in the central section 26 can also be of different lengths.

In order to account for different lengths of the flow paths 38, 39 within the central section 26, the first end section 22, the first morphing section 24, the second morphing section 28 or the second end section 30 can be of different lengths within each flow path. For example in FIG. 3 the enclosed flow paths are shorter in length and hence the first end section 22 comprising the first, rectangular, cross section 52 extends further along each of the enclosed flow paths.

Additionally, due to the way the enclosed flow paths 40 are formed, the side wall 46 constraining the will get gradually further from the second end turnaround section 42 for the enclosed flow paths 40 closest to the separating wall 36.

FIGS. 5A-5D show a heat exchanger 60 formed of multiple adjacent layers 20. Each alternating later is rotated by 180 degrees so that the first end section 22 of one layer is in between and in contact with the turnaround section 42 of the second end section 30 of the adjacent layers. The central sections, with the flow paths having the second cross section, have flow paths interleaved together. FIGS. 5A-5D shows a heat exchanger 60 comprising six layers 20, or a part of a heat exchanger that can have more than six layers. It will be appreciated that any number of the layers 20 can be placed together.

Figure 5A:
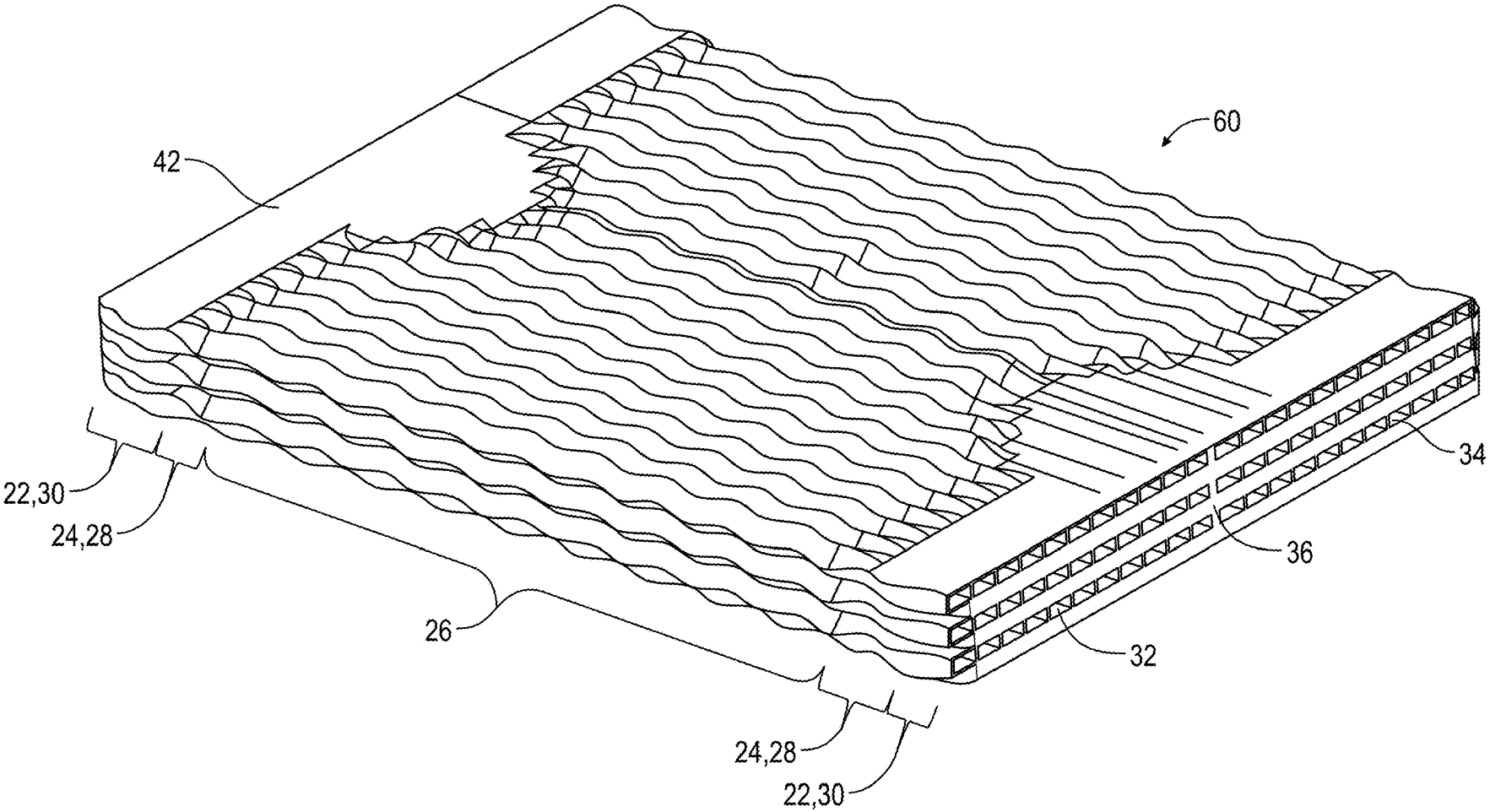
FIG. 5A shows a heat exchanger, or a part of a heat exchanger, comprising six layers.

FIG. 5A shows the complete six layer heat exchanger 60 showing the inlets of the outward section of the flow path 38 and the outlets 34 of the return flow paths 34 separated by the separating wall 36.

The flow paths of the central section 26 are shorter closer to the separating wall 36. These flow paths are the enclosed flow paths 40 as shown on FIG. 3. At the second end 30 the enclosed flow paths 40 do not extend to the turnaround section 42 and in the first end 22 the section of the enclosed flow paths 40 with the first cross section 52 extends further along the flow path. The length that the first cross section 52 extends along the enclosed flow path 40 is equivalent to the distance between the end of the enclosed flow path 40 and the turnaround section 42. This allows the layer to be rotated by 180 degrees and overlaid.

Figure 5B:
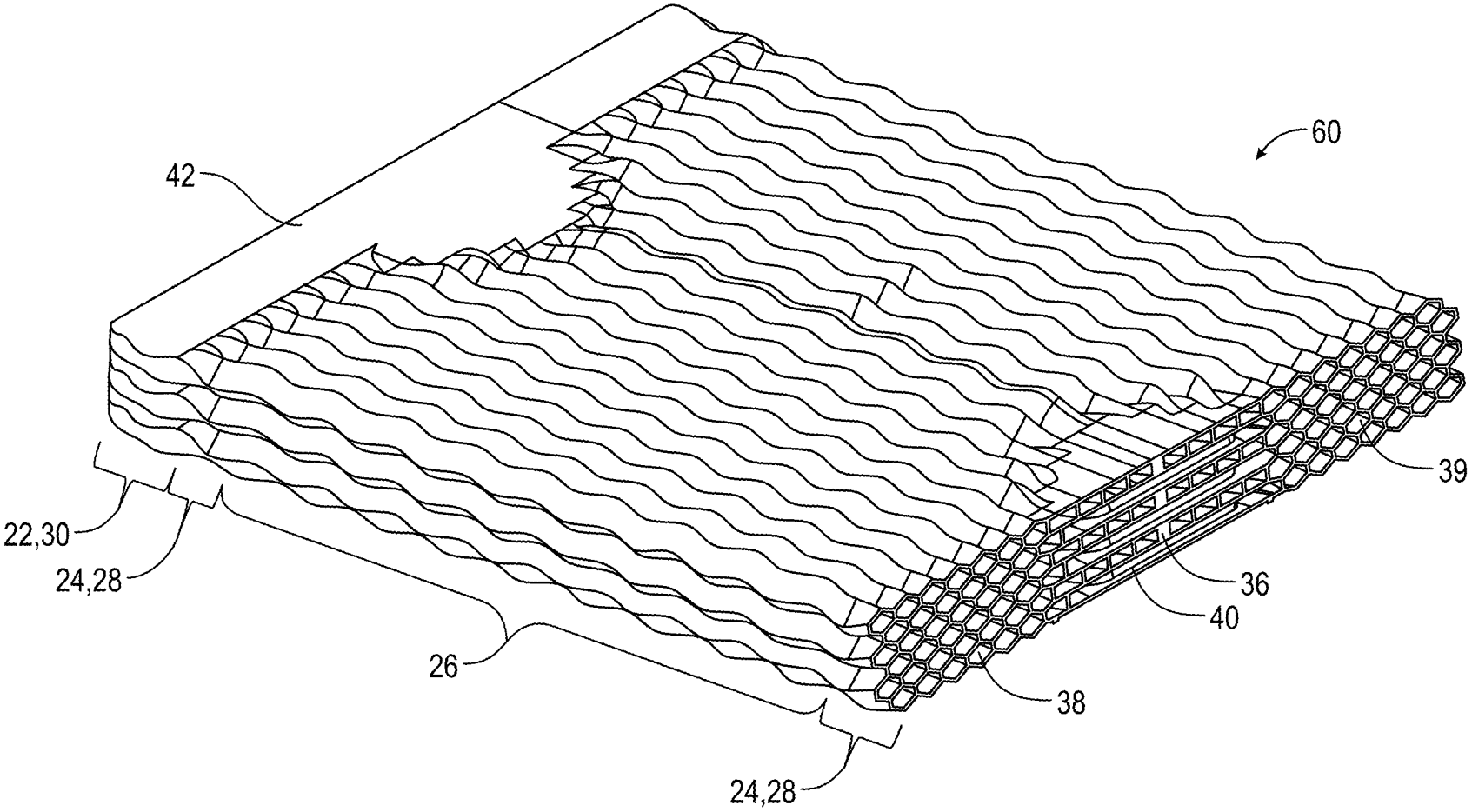
FIG. 5B shows the layers of FIG. 5A with a cut through a morphing section.

FIG. 5B shows the six layers 20 with a cut-away showing the first and second morphing sections 24, 28. The cross section of the flow paths 38, 39 are in the morphing stage between the first cross section 52 and 54, but with the same cross-sectional area.

As discussed previously, in the enclosed flow paths 40, the section with the first cross section 52 extends for longer than in the other flow paths 38, 39. Hence, in FIG. 5B at the point of the cut-away the flow paths 38, 39 have a morphed cross section, while the enclosed flow paths 40 have the first cross section 52.

Figure 5C:
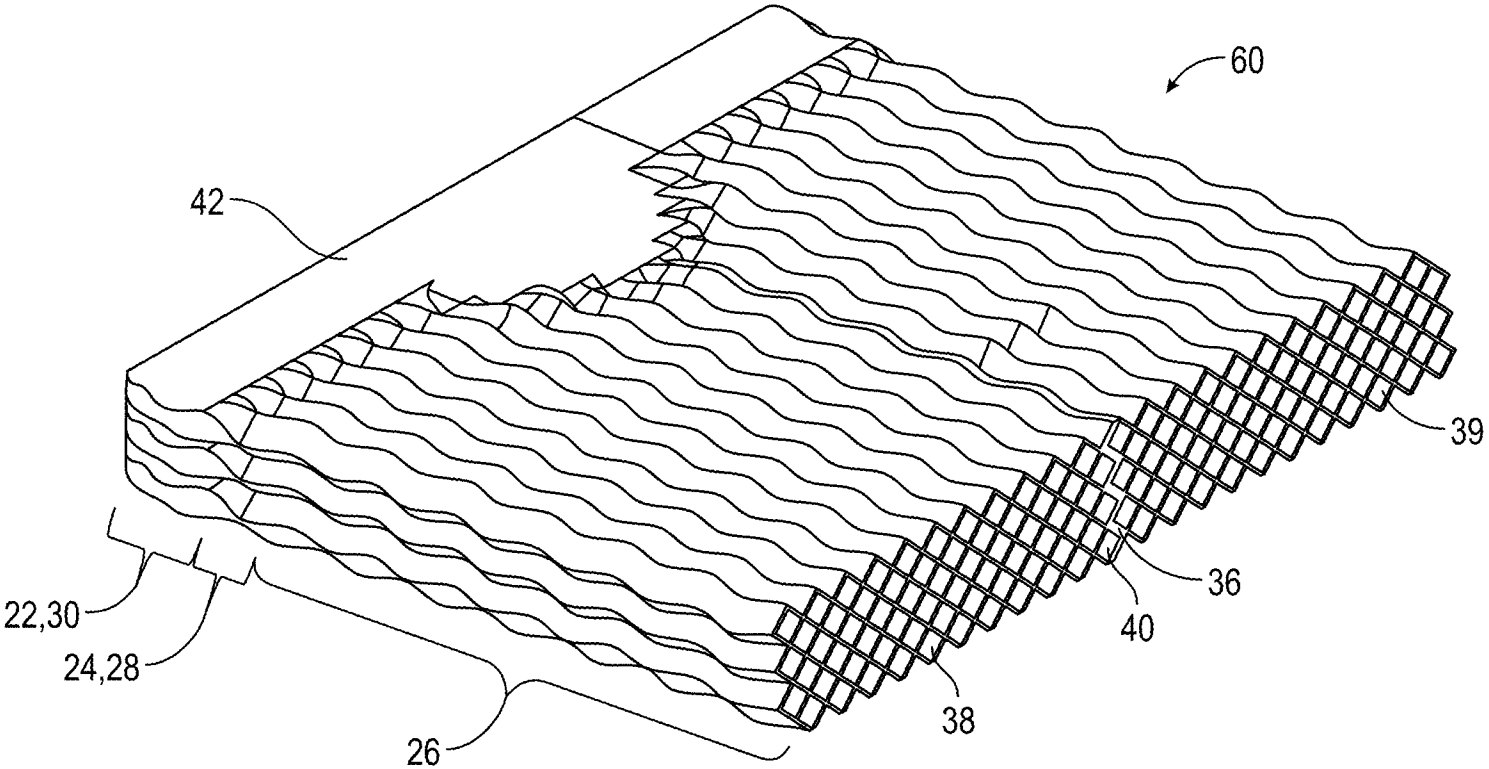
FIG. 5C shows the six layers of FIG. 5A with a cut through a central section.

FIG. 5C shows another view of the six layers 20 showing only the central section 26, the second morphing section 28 and the second end section 30 with the turnaround section 42. The cutaway shows all the flow paths 39, 39, 40 having the second cross section 54, in this case a diamond cross section.

Figure 5D:
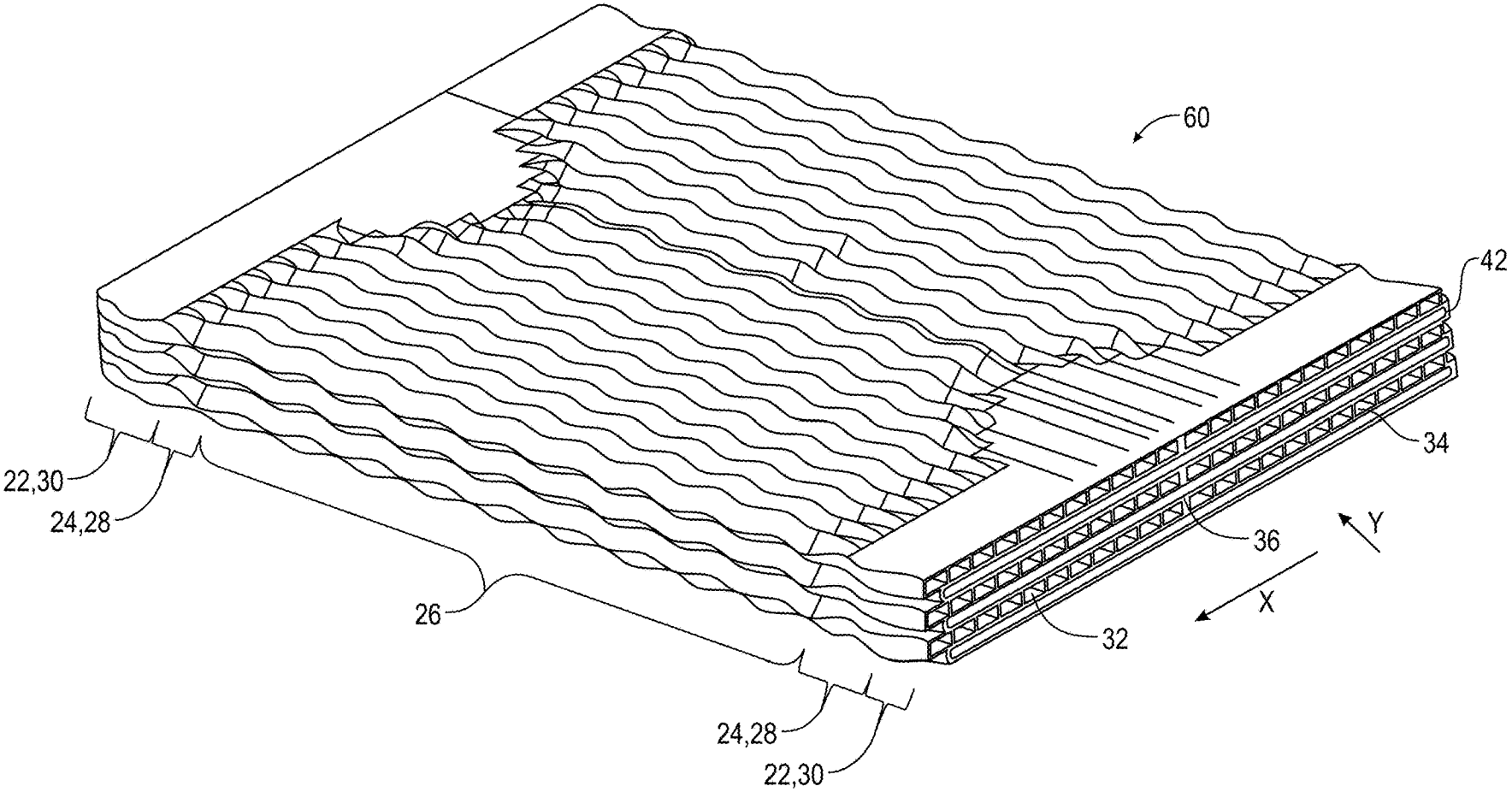
FIG. 5D shows the layers of FIG. 5A with a cut through a first end section.

FIG. 5D shows another view of the six layers with a cut-away in the first end section 22 and second end section 30 of the layers 20. The cut-away section shows the inlets 31 and outlets 34 of the first end 22 of the layers 20, and the turnaround section 42 of the second end 30 of the alternating layers.

In use the arrangement of the alternating layers 20 rotated by 180 degrees allows for two-pass flow with the primary and secondary fluid travelling in opposite directions. It also allows for counter flow between the flow in the inlet 32 and outlet 34 travelling in the Y direction and the flow in the turnaround section 42 of the adjacent layers travelling in the perpendicular X direction.

The invention claimed is:

1. A layer for a multilayer heat exchanger, the layer comprising:

a plurality of flow paths;

a first end section comprising a plurality of flow path inlets and a plurality flow path outlets;

a second end section comprising a turnaround section; a first morphing section fluidly connect to the first end section;

a second morphing section fluidly connected to the second end section; and a central section positioned between and fluidly connected to the first and second morphing sections;

wherein the plurality of flow paths extend from the flow path inlets in the first end section to the flow path outlets at the first end section via the turnaround section at the second end section to allow for two-pass flow;

wherein in the first end section and the second end section the flow paths have a first cross section;

wherein in the central section the flow paths have a second cross section;

wherein in the first and second morphing sections, the cross section of the flow paths morphs between first cross section and the second cross section;

wherein the first and second morphing sections allow the first end section, the central section, and the turnaround section to be integrated within the layer as one continuous flow path without the need for a separate turnaround section to redistribute the flow in use;

wherein the layer of the heat exchanger is separated into a first side and a second side by a separating wall extending in a longitudinal direction of the layer; and wherein the layer comprises one or more enclosed flow paths adjacent to the separating wall which do not extend into the turnaround section.

2. A layer of a heat exchanger as claimed in claim 1, wherein the first cross section allows for the first and second end sections to fit within an area of a first, relatively small, depth, compared to the second cross section which results in the central section extending across a second, larger depth.

3. A layer of a heat exchanger as claimed in claim 1, wherein the second cross section is arranged such that the flow paths thereof will be interleaved with flow paths of an adjacent layer.

4. A layer of a heat exchanger as claimed in claim 1, wherein the first cross section is rectangular and the second cross section is a diamond shape.

5. A layer of a heat exchanger as claimed in claim 1, wherein the first cross section is rectangular and the second cross section is hexagonal.

6. A layer of the heat exchanger as claimed in claim 1, wherein the cross section of the morphing section is an irregular hexagonal shape.

7. A layer of a heat exchanger as claimed in claim 1, wherein the flow paths have a constant cross-sectional area along their length.

8. A layer of a heat exchanger as claimed in claim 7, wherein the plurality of flow paths comprise a plurality of outward flow paths and a plurality of return flow paths formed in the first side and second side of the layer respectively.

9. A layer of a heat exchanger as claimed in claim 1, wherein the turnaround section is directly and fluidly connected to all the flow paths within the layer.

10. A layer of a heat exchanger as claimed in claim 8, wherein vanes extend from the plurality of outward flow paths into the turnaround section.

11. A heat exchanger comprising:

two or more of the layers as defined in claim 1.

12. The heat exchanger of claim 11, wherein each of two or more layers is rotated by 180 degrees with respect to an adjacent layer.

13. A heat exchanger as claimed in claim 12, wherein the cross-sectional area or cross sectional shape of the plurality of flow paths in one or more layers of the heat exchanger is different.

* * * * *